United States Patent [19]

Magnussen, Jr.

[11] Patent Number: 4,556,147

[45] Date of Patent: Dec. 3, 1985

[54] FRESH FRUIT PACKAGE

[76] Inventor: Robert O. Magnussen, Jr., 20442 Lake Canyon Dr., Walnut, Calif. 91789

[21] Appl. No.: 698,119

[22] Filed: Feb. 4, 1985

[51] Int. Cl.[4] ..... B65D 77/00

[52] U.S. Cl. ..... 206/493; 206/499; 206/525; 229/43; 426/106

[58] Field of Search ..... 206/493, 525, 499; 229/43; 426/106, 110, 115, 124, 392, 397

[56] References Cited

U.S. PATENT DOCUMENTS

| | | | |
|---|---|---|---|
| 1,916,037 | 6/1933 | Carlsen | 206/499 |
| 2,663,450 | 12/1953 | Bourcart | 206/499 |
| 2,893,550 | 7/1959 | Sandmeyer | 206/499 |
| 3,121,511 | 2/1964 | Whitehead | 206/499 |
| 3,365,308 | 1/1968 | Janicke | 206/45.33 |
| 3,451,328 | 6/1969 | Swett | 150/55 |
| 3,498,525 | 3/1970 | Zinkgraf | 229/43 |
| 3,529,531 | 9/1970 | Swett | 206/525 |

*Primary Examiner*—George E. Lowrance
*Assistant Examiner*—Jimmy G. Foster
*Attorney, Agent, or Firm*—William W. Haefliger

[57] ABSTRACT

A package for fresh fruit characterized as having a lower surface forming an upward, re-entrant recess, the package comprising (a) a cup-shaped container to receive the fruit, (b) first locating structure in the container to project upwardly into that recess, thereby to position the lower extent of the fruit, limiting its sideward movement relative to the container, (c) and second locating structure in the container to engage the upper extent of the fruit, thereby to position same limiting its sideward movement relative to the container, the second structure including a deformable sheet. The second structure may be integral with the container's cover.

4 Claims, 6 Drawing Figures

FRESH FRUIT PACKAGE

BACKGROUND OF THE INVENTION

This invention relates generally to packaging of fruit, and more particularly to a protective package for individual pieces of fruit, such as single apples.

The expense and handling of fruit, and especially prime apples, for example, creates a need for their protection, as during transport and other handling prior to reception by the consumer. Also, protective gift packaging or packaging for other purposes is frequently needed.

SUMMARY OF THE INVENTION

It is a major object of the invention to provide a unique, attractive, efficient and inexpensive package for individual pieces of fruit, such as apples, for example. Such fruit typically has one or more surfaces providing re-entrant recesses. Basically, the package of the invention comprises:

(a) a cup-shaped container to receive said fruit, (b) first locating means in the container to project upwardly into said recess, thereby to position the lower extent of the fruit limiting its sideward movement relative to the container, (c) and second locating means in the container to engage the upper extent of the fruit, thereby to position same limiting its sideward movement relative to the container, said second means including a deformable sheet.

Typically, the container is sized to closely surround the fruit, in spaced relation thereto; a lid on the container retains the said second locating means in downwardly partly deformed and compressing tensioned condition; and fruit is positioned in the container by the first and second deformable means, in closely spaced relation to the container wall surrounding the fruit. The fruit may consist of an apple, and the container and lid may consist of thin walled, molded synthetic resin.

It is a further object of the invention to provide the second locating means in the form of a sheet having turned edge portions engaging an inner wall defined by the container. That sheet may have a centrally located conical projection to downwardly enter a re-entrant recess defined by the upper extent of said fruit. Likewise, the first locating means may have a centrally located, generally conical projection to upwardly enter the lower re-entrant recess; and that projection may be integral with the container bottom wall, these features providing essential simplicity of construction of the package.

These and other objects and advantages of the invention, as well as the details of an illustrative embodiment, will be more fully understood from the following specification and drawings, in which:

DRAWING DESCRIPTION

DETAILED DESCRIPTION

Figure 1:
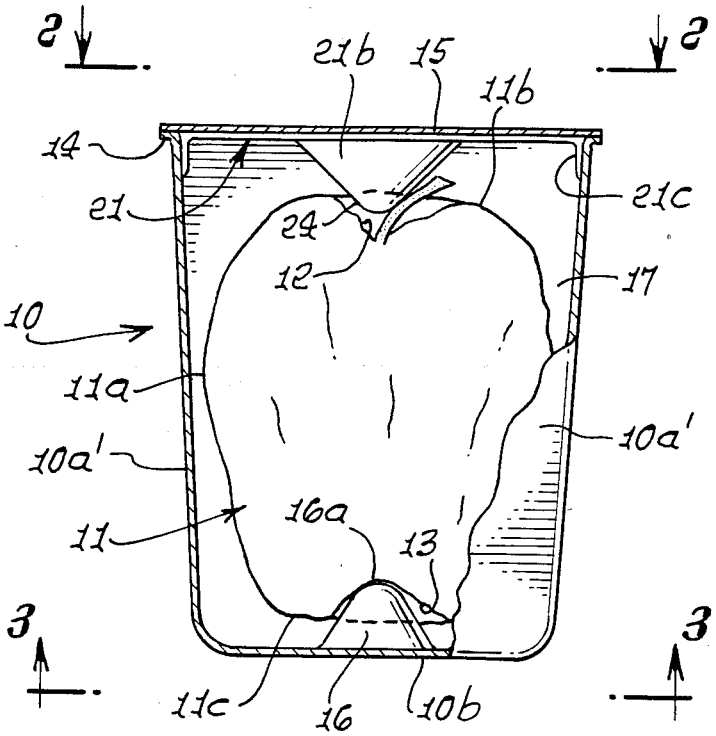
FIG. 1 is a side elevation showing a package incorporating the invention.
Figure 2:
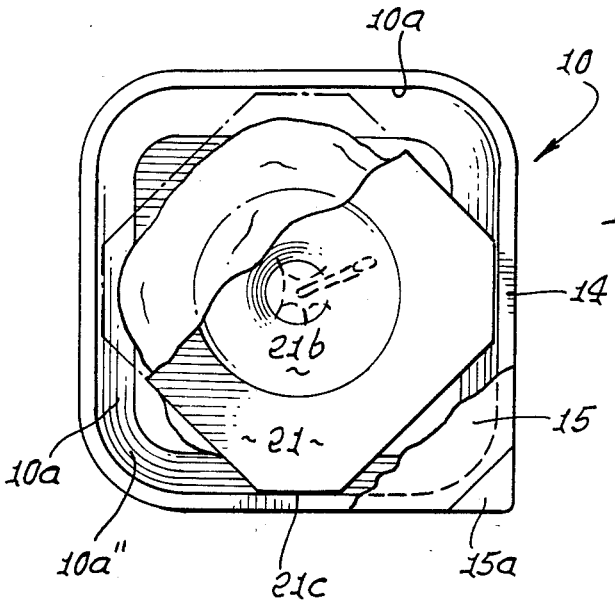
FIG. 2 is a top plan view on lines 2—2 of FIG. 1.

Package 10 shown in the drawings is especially adapted in its construction for safe, protective encapsulation or retention of fresh fruit, as for example an apple 11. The latter has bulbous side surface 11*a*, an annularly upwardly convex top surface 11*b*, and an annularly downwardly convex bottom surface 11*c*. The top surface 11*b* forms a downwardly re-entrant, generally centrally recess 12; and the bottom surface 11*c* forms an upwardly re-entrant, generally central recess 13.

Figure 3:
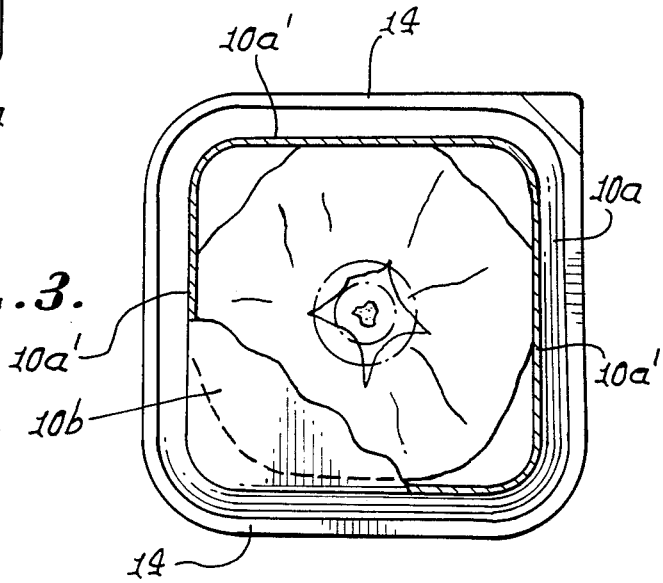
FIG. 3 is a bottom plan view on lines 3—3 of FIG. 1.

In accordance with the invention, the pacakge 10 comprises a cup-shaped container or receptacle having a thin side wall 10*c* and thin bottom wall 10*b*, and consists of synthetic resin such as polyethylene or polystyrene, for example. Side wall 10*a*, is shown as generally four-sided, the sides indicated at 10*a*′ and joined by convex corner walls 10*a*″. All such walls taper downwardly, to join the bottom wall 10*b* at convex corners 10*b*′. The side walls 10*a*′ and corner walls 10*a*″ turn outwardly at their uppermost extents to form a peripheral flange or rim 14 (see FIG. 3), to which a tear-off lid 15 is attached about the uppermost periphery of the container. Such attachment may be effected as by a suitable adhesive. A corner portion 15*a* of the thin lid projects outwardly to be manually grasped for tear-off removal of the lid, to gain access to the interior of the container. Lid 15 for example may consist of the same plastic material as the container.

In accordance with the invention, first locating means is provided in the container to project upwardly into said recess, thereby to position the lower extent of the fruit, limiting its sideward movement relative to the container. Also, second locating means is provided in the container to engage the upper extend of the fruit, thereby to position same limiting its sideward movement relative to the container, said second means including a deformable sheet.

As shown in the example, the first locating means may be molded integrally with bottom wall 10*b*, to comprise a part of that wall. It takes the form of a centrally located, generally conical projection 16 having a smoothly domed top surface 16*a* so as not to injure the apple when received relatively upwardly in apple bottom recess 13, to seat or support, and centrally locate the apple in spaced relation to the container side walls. See space 17 between the side of the apple and the container walls.

The second locating means is indicated generally at 21 as located between the lid and the top surface 11*b* of the apple, and characterized as protectively retaining the apple in position, vertically, relative to and spaced from the container walls 10*a*′ and the lid. For this purpose, the locating means 21 may be resiliently compressed, or deformed, between the lid and the top of the apple, and it may center the top of the apple in the container.

Figure 4:
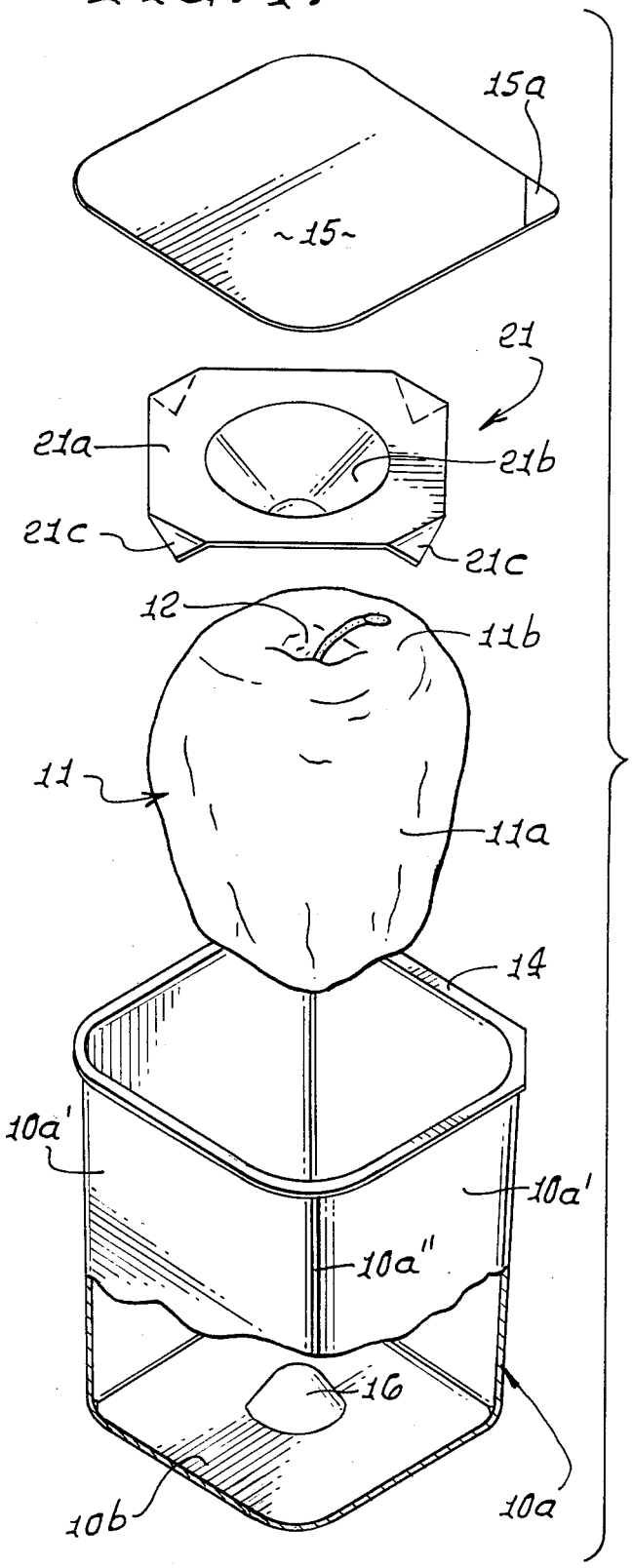
FIG. 4 is an exploded perspective view of the FIG. 1 package.

In the example, the retainer 21, in undeformed condition (FIG. 4) comprises a sheet of material such as very thin plastic material having a first portion 21*a* extending in a generally horizontal plane to provide a vertically resiliently flexing flat spring; a central portion in the form of a downward conical projection 21*b* to enter the apple recess 12; and portions 21*c* located to engage the inner sides of container side walls 10*a*′. Four of such portions 21*c* may be employed to engage the four walls 10*a'*. The central projection 21*b* has a downwardly smoothly rounded crest 24 to engage the apple re-entrant top wall, without injuring same, even though the retainer is "crushed" downwardly by the lid, and resiliently compressed.

As is clear, the apple is completely protected by the described package, and only the re-entrant surfaces of the apple are engaged, but in a protective manner. The package may be transported, with force application to it, without injuring the apple, since the apple is spaced from the container side walls, and resiliently suspended between and spaced from the annular bottom wall 10*b*, and the lid 15. In use, the lid 15 is easily torn off the container, and the latter is inverted to drop out the retainer 21 and the apple.

Figure 5:
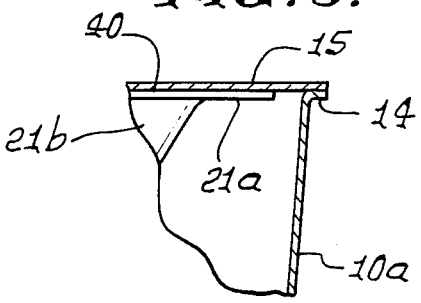
FIG. 5 is a fragmentary view showing a modification.

In FIG. 5, the elements are the same, except that the retainer sheet 21*a* is attached to the lid, as at interface 40; also, the downturned corners 21*c* of the retainer sheet are not present. The sheet and lid may be of one-piece construction.

Figure 6:
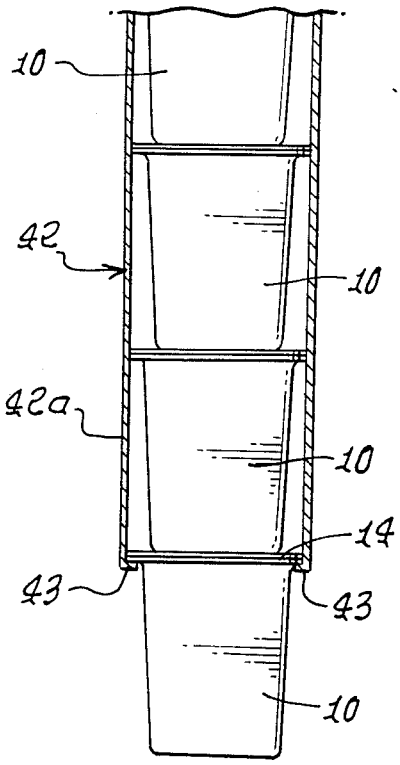
FIG. 6 is a side elevation showing a package fruit dispenser.

In FIG. 6, a dispenser 42 dispenses a stack of the packages 10, one at a time. For example, the dispenser tube 42*a* receives the stacked packages 10, and guides their vertical downward movement, as the lowermost package is manually removed. A lip or lips 43 on the dispenser, or equivalent means, supports the package, as at flange or flanges 14, to allow tilting of the package, dislodging it from the flange or flanges and allowing pull-out removal of the package.

I claim:

1. In a package for fresh fruit characterized as having a lower surface forming an upward, re-entrant recess, the combination comprising (a) a cup-shaped container to receive said fruit, (b) first locating means in the container to project upwardly into said recess, thereby to position the lower extent of the fruit, limiting its sideward movement relative to the container, (c) and second locating means in the container to engage the upper extend of the fruit, thereby to position same limiting its sideward movement relative to the container, said second means including a deformable sheet, (d) said container having a thin side wall and thin bottom wall and consisting of synthetic resin, the side wall comprising four substantially flat side wall portions joined by four outwardly convex corner wall portions, all such wall portions tapering downwardly, to join the bottom wall at outwardly convex corners, the side wall portions and corner wall portions turning outwardly at their uppermost extents to form a continuous peripheral flange, extending about a container mouth, (e) and a tear-off lid removably attached to said flange and retaining said second locating means in the container, the lid being removable from the flange by tear-off to thereby allow upward removal of the second locating means and removal of the fruit in the container via the container mouth, (f) said container wall portions being sized to closely surround said fruit, in spaced relation thereto, said second locating means having a centrally located conical projection to downwardly enter a re-entrant recess defined by the upper extent of said fruit, said projection having a downwardly domed convex terminus, said lid having a projecting tab adapted to be pulled upwardly to remove the lid from the container, said first locating means having a centrally located, generally conical projection to upwardly enter said upwardly re-entrant recess, said projection having an upwardly domed convex terminus, (g) said removable lid being integral with said downwardy domed conical projection, and said bottom wall being integral with said upwardly domed conical projection.

2. The combination of claim 1 wherein said container is sized to closely surround said fruit, in spaced relation thereto, the container consisting of molded synthetic resin, and including said fruit suspended at all times by and between said domed termini and in spaced relation from said lid and bottom wall.

3. The combination of claim 1 wherein said fruit consists of an apple.

4. The combination of claim 2 including a dispenser receiving a stack of said packages, for successive dispensing, the dispenser comprising an upright tube and has a lower opening via which said packages are dispensed, the lowermost package supported by the dispenser until it is manually removed from beneath the next above package.

* * * * *